United States Patent [19]

Garrett

[11] 3,966,172

[45] June 29, 1976

[54] LIGHTWEIGHT FENCE FOR PROTECTION AGAINST AIRBORNE SNOW, SAND OR THE LIKE

[76] Inventor: Herbert V. Garrett, 8112 Belleforest Drive, Vienna, Va. 22180

[22] Filed: Nov. 19, 1974

[21] Appl. No.: 525,282

[52] U.S. Cl. ..... 256/12.5; 61/3

[51] Int. Cl.[2] ..... E01F 7/02

[58] Field of Search ..... 61/3, 4; 256/12.5, 64

[56] References Cited

UNITED STATES PATENTS

| | | | |
|---|---|---|---|
| 76,102 | 3/1868 | Roberts | 256/64 |
| 257,168 | 2/1882 | Lape | 256/64 |
| 1,775,820 | 9/1930 | Johanes | 61/3 |
| 2,655,790 | 10/1953 | Daley | 61/3 |

FOREIGN PATENTS OR APPLICATIONS

| | | | |
|---|---|---|---|
| 61,263 | 8/1943 | Denmark | 256/12.5 |

*Primary Examiner*—Paul R. Gilliam
*Assistant Examiner*—Doris L. Troutman
*Attorney, Agent, or Firm*—Antonio F. Guida

[57] ABSTRACT

An easily transportable or shiftable fence for use in protecting areas against wind-blown snow, sand or the like, and comprises a plurality of pliant, deformable or resilient strips mounted upon a plurality of A-frame members.

13 Claims, 8 Drawing Figures

FIG. 1.
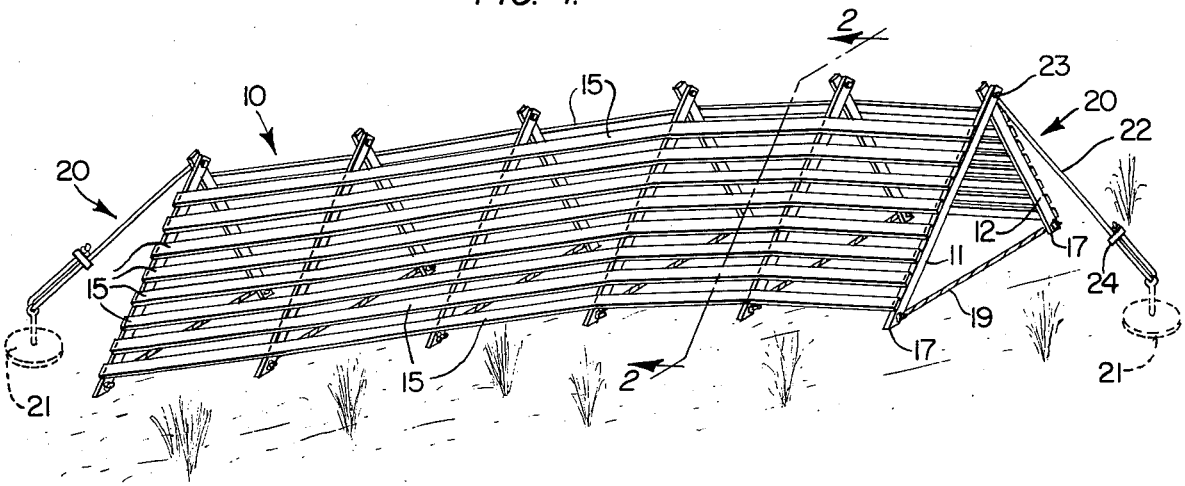
FIG. 8.
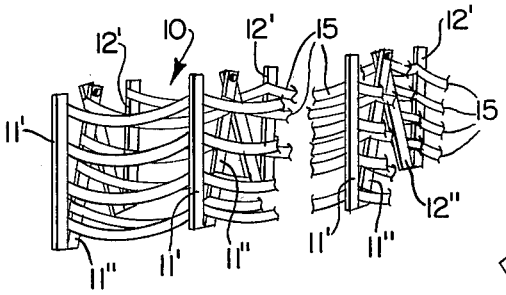
FIG. 2.
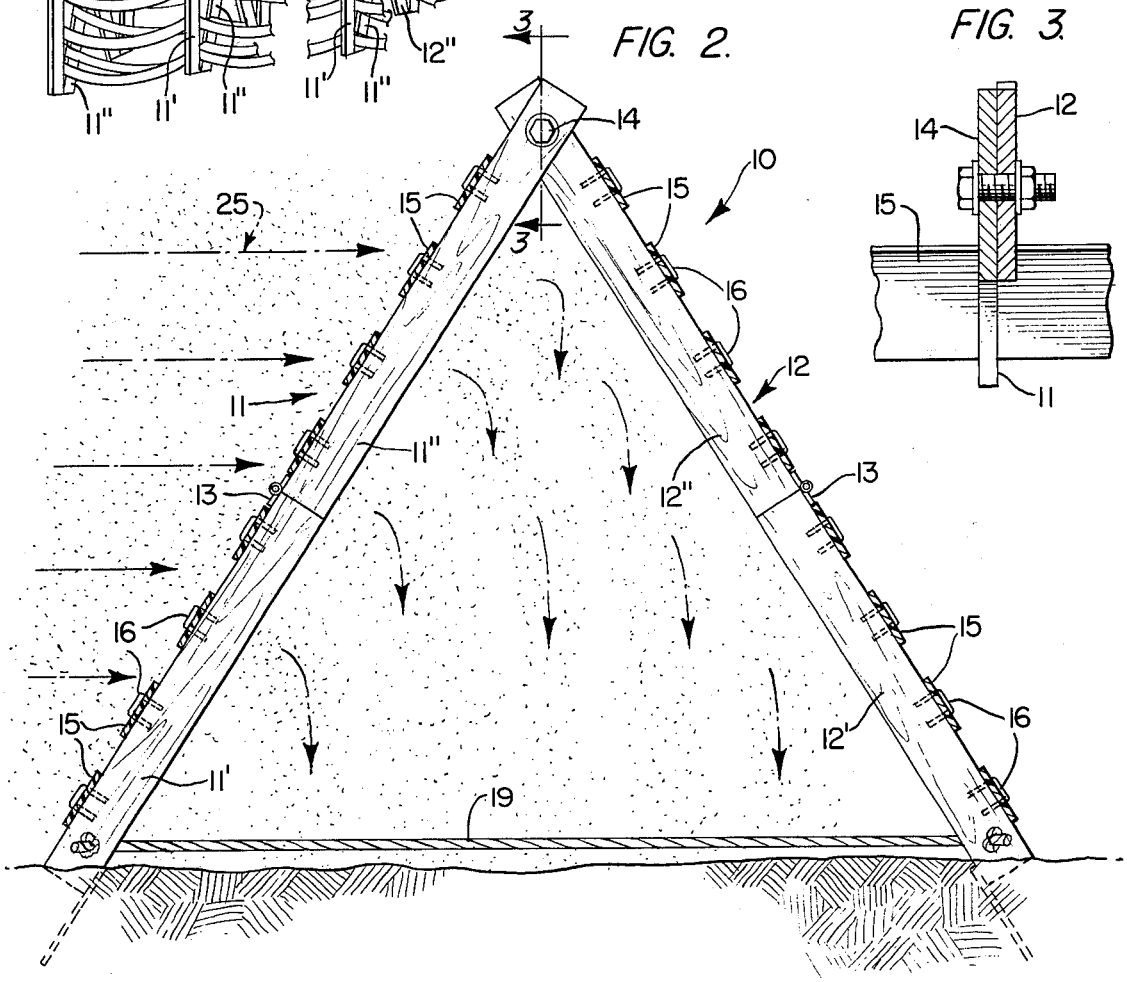
FIG. 3.

LIGHTWEIGHT FENCE FOR PROTECTION AGAINST AIRBORNE SNOW, SAND OR THE LIKE

BACKGROUND OF THE INVENTION

The field of this invention pertains to the problems of preventing the obstructive and destructive flow of sand, snow or the like along rights-of-way, highways, beaches, etc.

Many devices for these purposes have been previously disclosed and are well known. These devices have numerous short-comings. They are generally expensive, cumbersome and of limited utility. These devices require complicated assembly structures and usually entail the cooperative efforts of two or more workmen to be properly positioned.

It is accordingly an object of this invention to provide an improved fence to be used principally for preventing airborne sand or snow from drifting, while permitting the air to flow therethrough.

It is a further object of this invention to provide a fence of a character having pliant or resilient strips, slats or the like wherein one individual may easily transport and erect a long section of such fence.

Another object of this invention is to provide a fence of a character wherein the strips or slats may be fastened upon the surfaces of a plurality of A-frame members, wherein airborne material, when flowing through the area encompassed by the A-frames, is caused to be precipitated in such area.

Another object of this invention is to provide a fence wherein the strips or slats are freely pivoted to the A-frame members whereby, when the air and airborne material impinges upon the surfaces thereof the strips or slats will pivotally, resistingly yield in direct proportion to the velocity thereof.

A further object of this invention is the provision of a fence comprised of a plurality of A-frames interconnected by a series of strips or slats to form a fence unit and wherein the ends of each fence unit are secured to the ground by tension adjustable guy wires.

A further object of this invention is the provision of a unit comprising a plurality of A-frames interconnected by a series of strips or slats wherein the unit may be utilized as a highway barricade to signal an obstruction or the like.

A further object of this invention is the provision of a unit comprising a plurality of A-frames interconnected by a series of strips or slats wherein the area encompassed by such unit may be utilized as a protective shelter from the sun's rays and the like.

Further objects will be found from a consideration of the following detailed description.

In the drawings:

FIG. 1 is a perspective view of a unit of one form of the fence of my invention;

FIG. 2 is a cross sectional view taken along line 2—2 of FIG. 1;

FIG. 3 is a section along line 3—3 of FIG. 2 and illustrating the pivotal juncture of the elements of the A-frame;

Figure 4:
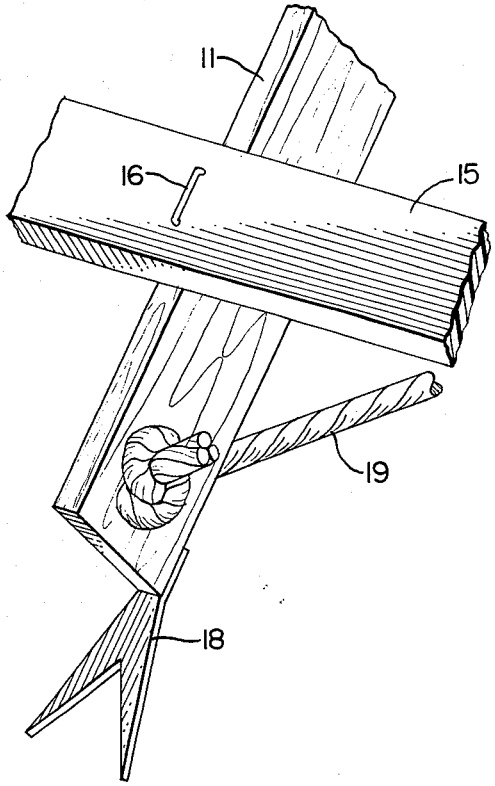
FIG. 4 shows the use of anchor cleats which may be utilized for increased stability. This view also illustrates one means for connecting the strips or slats to the elements of the A-frame.
Figure 6:
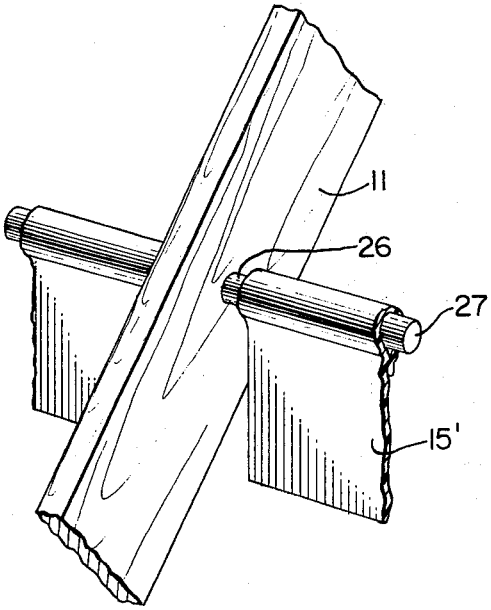
Figure 7:
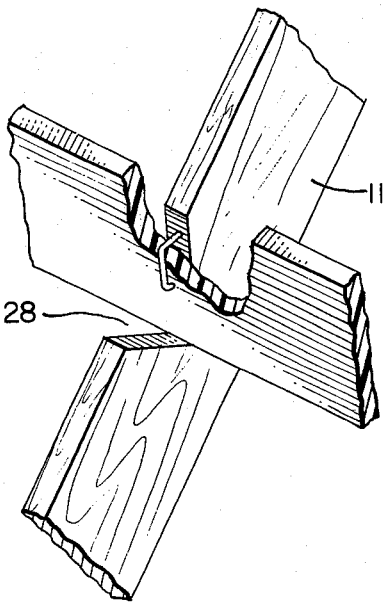

FIG. 6 discloses a further embodiment of the connection shown in FIG. 4;

FIG. 7 illustrates yet another embodiment of the connection shown in FIG. 4;

FIG. 8 shows the unit in collapsed condition ready for transport or storage.

Referring to the drawings wherein like reference characters refer to like parts, the improved fence unit 10 is shown in perspective in FIG. 1. The fence unit comprises a plurality of A-frames. Each A-frame comprises a pair of posts 11, 12. These posts may be of one piece as is shown in FIG. 1, or two pieces 11′, 11″, 12′, 12″ and hinged as at 13 in FIG. 2, for compact storage when not in use. Instead of the hinged arrangement I may telescope or slidably interrelate each post. The pair of posts is pivoted at 14. While I have shown the pivot as a nut and bolt, it is obvious that I may utilize a rivet or equivalent arrangement, as long as free pivoting is obtained.

Interconnecting successive A-frames is a plurality of substantially parallel strips or slats 15 fastened to the posts as at 16. The strips or slats may be of any of a plurality of readily available relatively inexpensive materials such as jute, fiber, wood, metal, cloth, plastic, paper of the like. These strips or slats have characteristics of being readily pliant, deformable, yieldable, capable of being coated with a reflective or other material.

Of particular note is the fact that both posts 11, 12 are provided with spaced strips or slats 15 for a reason that will become apparent as the description progresses. The arrangement of the strips or slats on the posts is such that they may be coincident, ie, the same distance from the ends of the respective posts, or they may be staggered. The lower ends 17 of the posts 11, 12 may be the sole ground contacting elements as is shown in FIG. 1, or they may be provided with cleats or anchors 18 as is shown in FIG. 4. The spread of the posts is controlled by an adjustable interconnecting member 19 of wire or rope of suitable material. The posts may, alternatively, be held apart by interlockable rigid members.

Several A-frames, interconnected by the strips or slats, comprise a unit. In FIG. 1 I have illustrated the unit as comprising six interconnected A-frames. It is obvious that more or less may be utilized, as desired. Similarly, the spacing between successive A-frames is not critical.

The A-frame at each end of the unit is provided with an adjustable anchoring guy member 20. The guy member is of a type commonly utilized in fastening tent poles and comprises an anchor 21 imbedded in the ground at some distance away from the terminal A-frame, and a rope or cable 22. The rope 22 is fixed to the A-frame as at 23 and the other end is adjustably related to the anchor by friction gripping means 24.

As has been previously stated, the several components of the unit are sufficiently compact and lightweight that one man may easily transport and assemble it. The unit illustrated in FIG. 1, for example, may extend over a range of 50–100 feet.

To collapse the unit the posts of the A-frame are pivoted together about 14 and the several A-frames are brought into juxtaposition for easy transport. If the posts are telescopic or hinged they will provide further compactability. To erect it at the desired location the several A-frames are moved away from each other the distance permitted by the length of the strips or slats, then the posts are pivoted apart the distance permitted by the adjustable length of the member 19. The guy member 20 at one end of the unit is disposed so that the A-frame at that end is substantially vertical. Then the guy member at the other end is fixed to the ground and its rope 22 is tightened to retain the several components in the relation shown in FIG. 1. A plurality of units may be extended end for end, in which case, one end of the successive unit may be fastened to the previous unit thereby eliminating one guy member, if desired.

My device may be utilized along a beach to combat erosion. Assuming the wind entrained sand is moving in the direction of the arrows 25, some of the sand will contact the strips or slats and be deflected. The remainder of the wind entrained sand will pass between the vertically spaced strips or slats and enter the area between the posts. Because this area is confined the velocity of the air is decreased and the sand will precipitate therefrom and fall to the ground in that area. Further, the flow of air is interrupted by the presence of the slats on the other posts 12 to create a turbulence which further contributes to precipitation of sand in the same area. As this action continues it can readily be seen that the accumulated precipitated sand will be mounded and further add to the stability of the fence. It should also be noted that the fence would be equally as effective should the wind be moving in the opposite direction. In either case the sand is retained on the beach at substantially the desired location thereby controlling erosion and preventing drifts from accumulating along roads and rights-of-way.

In use as a snow fence the fence is similarly erected and placed along a right-of-way or perpendicular to the direction of prevailing wind. The behavior of the airborne snow would be the same as that of the sand. In snow storms the direction of the wind frequently changes and my device remains effective irrespective of the direction of the prevailing winds.

This device may also be utilized as a quickly erected protective barrier in areas of construction or where an accident has occurred. The strips or slats could be of the light-reflective type to increase their effectiveness, and provided with appropriate indicia, as desired.

Figure 5:
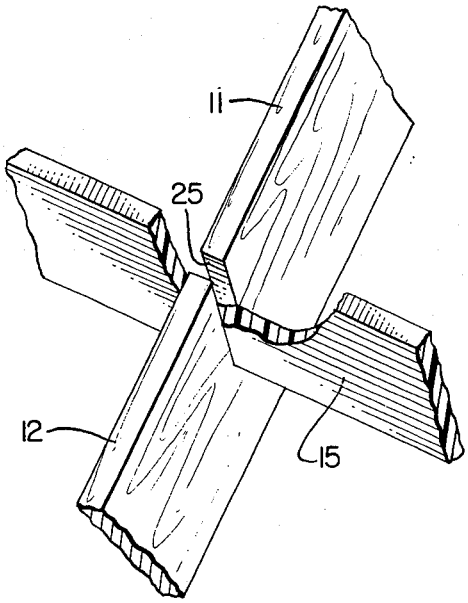
FIG. 5 illustrates another embodiment of the connection shown in FIG. 4.

FIG. 5 discloses a modified connection of the strips to the posts. In this arrangement the posts are slotted as at 25 and the strips inserted therein. The specific angle of the slot is not critical provided that when erected the strips will present their broad faces outwardly.

In the modification of FIG. 6 the posts 11, 12 are apertured at 26 to receive horizontal pivot members 27 to which are applied strips or slats 15'. In this modification the strips hang like a pendulum, but are free to swing in response to a strong wind.

FIG. 7 is similar to FIG. 5 except that the posts are notched and the strips are fastened to a face of the notch.

As can be readily observed, because of its light weight and compactability, one person may easily collapse, carry and stow each of the disclosed units. In view of the fact that the strips or slats are pliant, deformable and resilient, after the posts 11, 12 have been folded as shown in FIG. 8, the several A-frames are brought together, while permitting the strips to hang limp and one person may easily carry the entire unit to any desired location. Conversely, one individual may erect the entire fence unit by reversing the procedure. When it has been erected, the anchor members 20 are appropriately installed.

In view of this versatility, my device may also be utilized on construction sites, in areas of emergency by police and firemen to warn against hazzards, etc.

Inherently, my fence may also serve as a removable shelter over growing plants, against the harmful effects of frost and sun. In this use it may well be observed that the area enclosed within the shelter would have a moderating effect upon the extremes of cold and heat.

While I have shown and described several modifications of my invention, it is obvious that other modifications readily are apparent.

What I claim as my invention is:

1. An easily erectable-collapsible fence unit for use with snow-sand or the like, comprising a plurality of adjustable A-frames, each said A-frames comprising a pair of pivotally interconnected ground contacting posts; a plurality of strips interconnecting said A-frames, anchoring means operatively associated with said unit for maintaining the unit in erect condition, said strips being provided on each of said pivotally interconnected posts, each said strips being broad and flat, pliant and readily deformable; means adjacent the lower ends of said A-frames adjustably limiting the pivotal relation of the posts to adjust the vertical extent of the fence and establish the stability thereof and to modify the angular relation of the strips to the ground; whereby said posts may be pivotally moved toward or away from each other and said A-frames may be moved toward or away from each other.

2. A fence unit as defined in claim 1 wherein each said posts comprises an upper and a lower adjustably related piece and interconnecting strips are provided on at least some of said upper and lower adjustably related pieces.

3. A fence unit as defined in claim 1 wherein said unit includes terminal A-frames and said anchoring means are secured to said terminal A-frames.

4. A plurality of fence units as defined in claim 1 wherein one said fence unit is provided with anchoring means adjacent each terminal portion thereof and each successive fence unit is provided at one terminal portion with means for connecting it to a previous unit and at the other terminal portion with anchor means.

5. An easily erectably-collapsible snow or sand fence unit comprising a plurality of adjustable A-frames, each said A-frames comprising a pair of pivotally interconnected ground contacting posts; a plurality of strips attached to each of said posts and interconnecting said A-frames to provide a sand or snow accumulating chamber within the area encompassed by said A-frames and strips; anchoring means operatively associated with said unit for maintaining the unit in erect condition, each said strips being broad and flat, pliant and deformable; means adjacent the lower ends of said A-frames adjustably limiting the pivotal relation of said posts to adjust the vertical extent of the fence and establish the stability thereof and to modify the angular relation of the strips to the ground; whereby said posts may be pivotally moved toward or away from each other and said A-frames may be moved toward or away from each other.

6. A fence unit as defined in claim 5 wherein each said posts comprises an upper and a lower adjustably related piece and interconnecting strips are provided on at least some of said upper and lower adjustably related pieces.

7. A plurality of fence units as defined in claim 5 wherein one of said fence units is provided with anchoring means adjacent each terminal portion thereof and each successive fence unit is provided at one terminal portion with means for connecting it to a previous unit and at the other terminal portion with anchor means.

8. A fence unit as defined in claim 5 wherein said strips are substantially horizontal, parallel vertically spaced and are taken from the class of materials that comprises jute, fiber, wood, metal, cloth, plastic, paper or the like.

9. A fence unit as defined in claim 8 wherein said posts are slotted or notched and said strips are disposed therein.

10. A fence unit as defined in claim 8 wherein said posts are apertured to receive pivot members and said strips are pendulously attached thereto.

11. A fence unit as defined in claim 1 wherein said strips are substantially horizontally parallel vertically spaced and taken from the class of materials which comprises jute, fiber, wood, metal, cloth, plastic, paper or the like.

12. A fence unit as defined in claim 11 wherein said posts are slotted or notched and said strips are disposed therein.

13. A fence unit as defined in claim 11 wherein said posts are apertured to receive said pivot members and said strips are pendulously attached thereto.

* * * * *